US005524555A

United States Patent [19]

Fanuzzi

[11] Patent Number: 5,524,555

[45] Date of Patent: Jun. 11, 1996

[54] PORTABLE TREATMENT TABLE

[76] Inventor: John M. Fanuzzi, Hwy 89 Seven Point Ranch, Emigrant, Mont. 59027

[21] Appl. No.: 461,101

[22] Filed: Jun. 5, 1995

Related U.S. Application Data

[63] Continuation of Ser. No. 73,885, Jun. 9, 1993, abandoned.

[51] Int. Cl.[6] ..... A47B 3/00

[52] U.S. Cl. ..... 108/132; 108/36

[58] Field of Search ..... 108/35, 36, 127, 108/130, 131, 132, 133; 5/620

[56] References Cited

U.S. PATENT DOCUMENTS 4,143,601 3/1979 Pike .
4,833,998 5/1989 Everett ..... 108/36
4,943,041 7/1990 Romein .

FOREIGN PATENT DOCUMENTS 0082261 3/1957 Denmark ..... 108/35
0400752 8/1909 France ..... 108/36

*Primary Examiner*—Peter M. Cuomo
*Assistant Examiner*—Gerald A. Anderson
*Attorney, Agent, or Firm*—Dennis A. Bennett

[57] ABSTRACT

There is disclosed a portable treatment table. That is light weight and able to stably handle heavy loads. The table being folded into a portable configuration.

12 Claims, 4 Drawing Sheets

PORTABLE TREATMENT TABLE

This is a file-wrapper continuation of application Ser. No. 08/073,885 filed Jun. 9, 1993, abandoned.

BACKGROUND OF THE INVENTION

1. Field of the Invention

The invention relates to folding tables in general, and specifically to portable tables for use in massage or therapeutic body work such as for the chiropractic art.

2. Related Art

The prior art teaches a wide variety of special purpose folding tables for use in applications such as massage, therapy, chiropractic arts, article display, and beauty treatment as well as folding tables for general purpose use. A sample of these include U.S. Pat. No. 5,009,170 which discloses a brace and cable configuration for a portable table. U.S. Pat. No. 4,927,128, 4,856,497 and 4,333,638 which disclose other tables with varying truss suspension systems.

SUMMARY OF THE INVENTION

The presently disclosed invention consists of a special purpose table for use in massage or other body work such as the chiropractic arts. The table folds in halve and the legs and support struts are stored within the space between the two halves of the folded sections. When folded the table is easily able to be carried by one person where it is needed.

It is an object of the present invention to provide a folding table having a new and unique support structure that overcomes the problems found in prior art tables.

It is another object of the present invention to provide a portable table that is light weight, durable, stable when subject to dynamic and static loads and is easy to set up and break down.

It is another object of the present invention to provide a portable table that is more comfortable to use in that the therapist is able gain access to the underside of a patient easier and more comfortably than is able to be done with other known tables.

It is still another object of the present invention to provide a portable treatment table that is safer in operation because its support joints are less likely to fail and offers greater stability for the supported structure.

It is an advantage of the this novel portable table in that there are no offset hinge joints braces, as used in other conventional portable tables. This assures that little or no wear on the joint since the forces applied during use are in the same line and in the same plane.

It is still another advantage of the this novel portable table in that it makes use of a high strength stretchable fabric as the table top section this allows the table to be of a lighter weight and at the same time being of high strength.

These, together with the various ancillary objects and features of the instant invention which will become apparent as the following description proceeds, are attained by this folding, portable massage table as disclosed herein, preferred embodiments thereof being shown in the accompanying drawings, by way of example only.

DRAWING REFERENCE NUMERALS

10—Folding Table
20—Top section
25—Cushion pad
30—Support legs
35—First pivot means
36—Second pivot means
37—Third pivot means
40—First cross brace
50—First length
60—Second length
80—Border flange
90—Carrying handle
101— Flexible nylon material
110—Latch
115—Latch clasp
130—First cable
170—Support foot
200—Hinge member

DETAILED DESCRIPTION OF THE PREFERRED EMBODIMENTS

Figure 1:
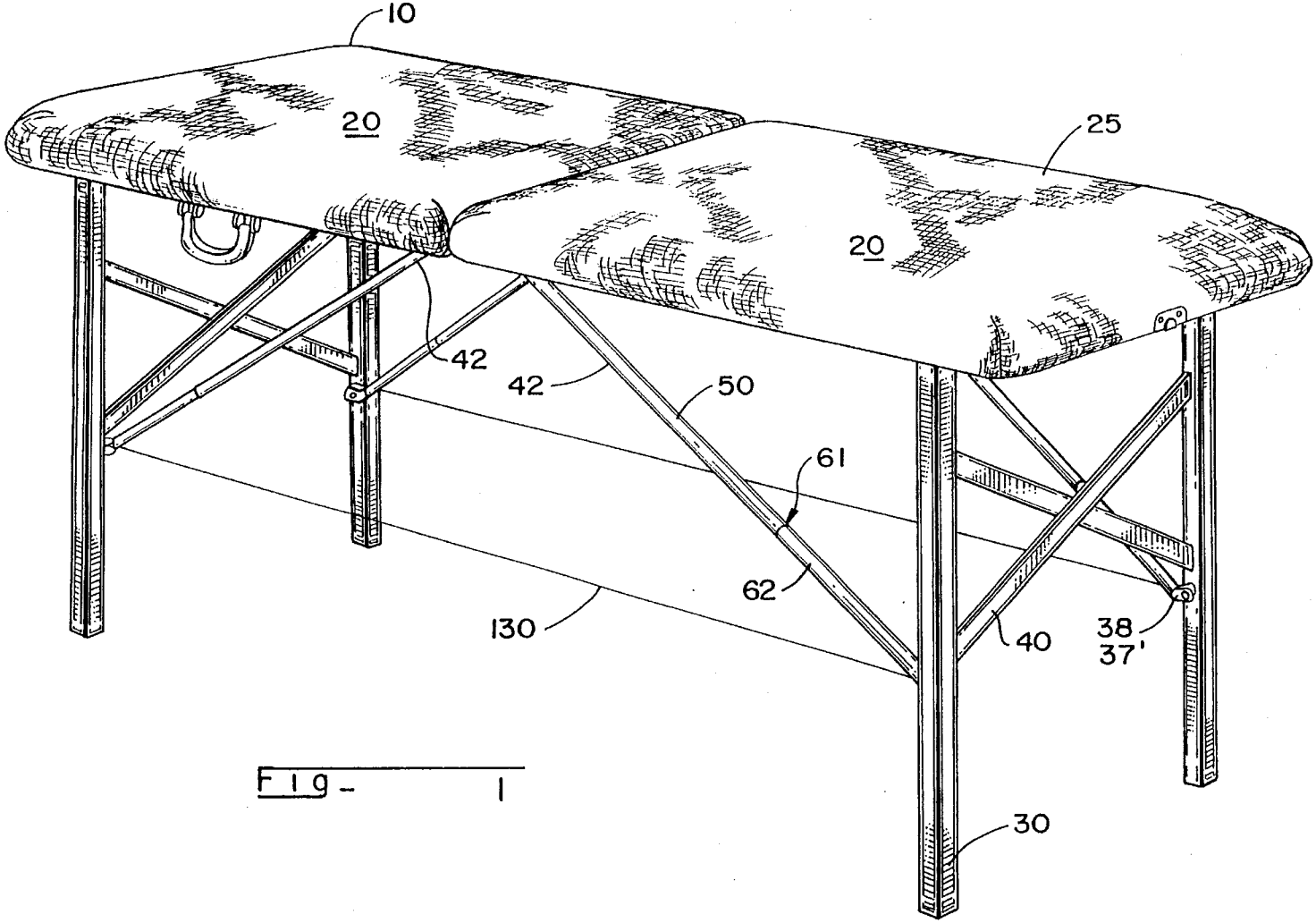
FIG. 1 is a perspective view of the claimed table shown in an assembled condition ready for receiving a patient for treatment.
Figure 2:
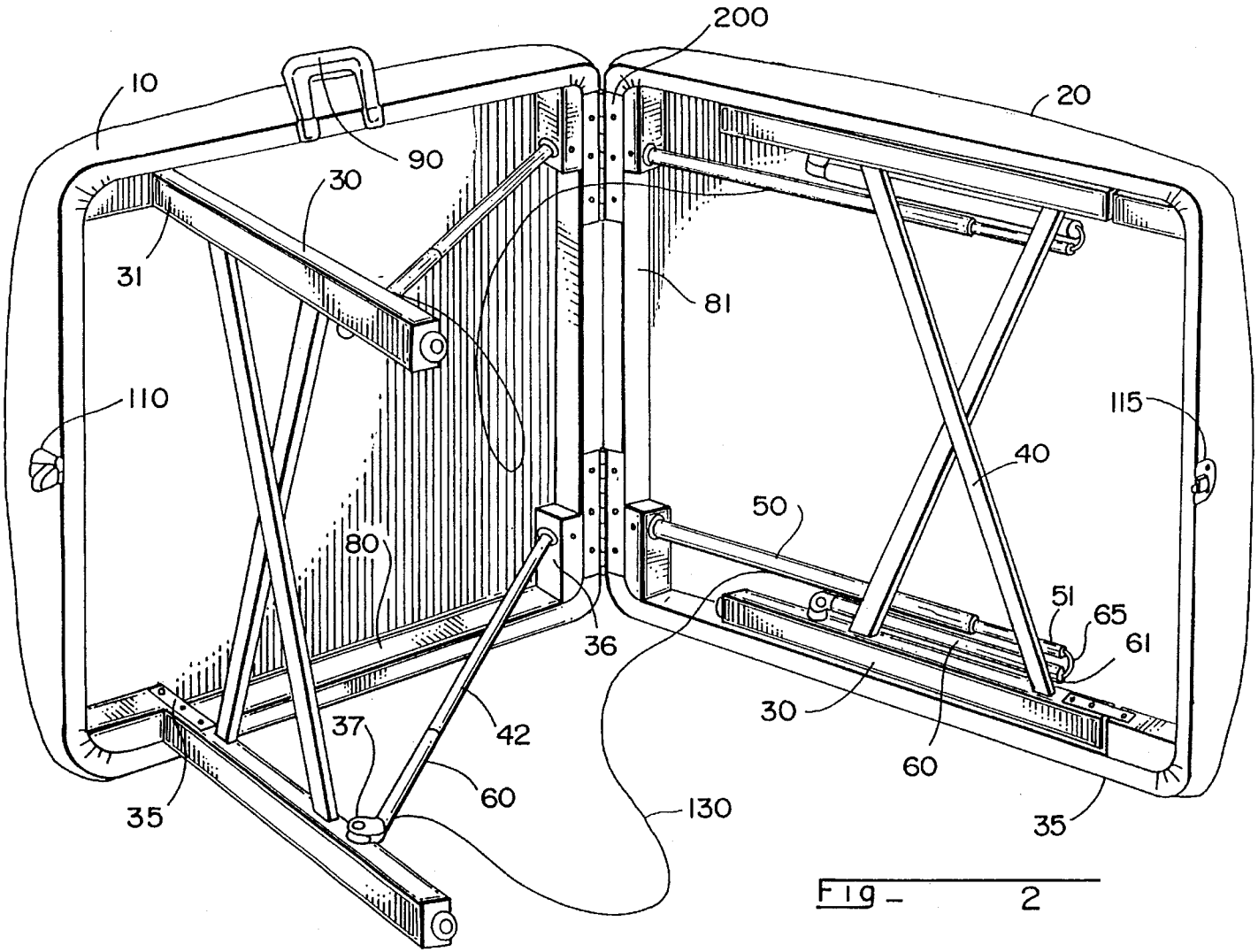
FIG. 2 is a perspective view of the table shown in FIG. 1 in a partially folded condition.
Figure 3:
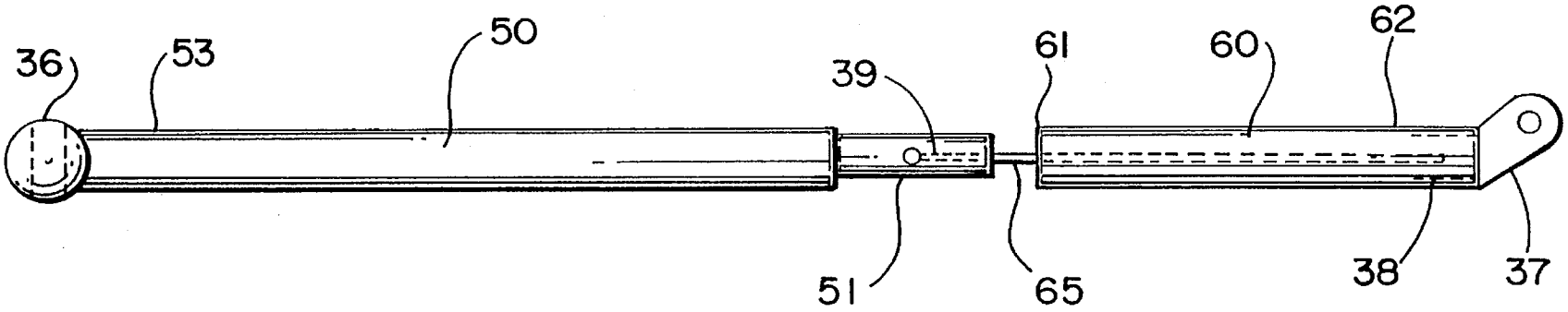
FIG. 3 is a perspective view of a support arm with its first and second section separated.

As shown in FIGS. 1 and 2, portable folding treatment table 10 comprises two rectangular flat top sections 20 each of which contains, on its under surface a peripheral border flange 80 anchored or attached to top sections 20 with glue, nails or angle brackets or the like. Sections 20 are abutted and connected by hinge members 200 attached to the bottom surface of abutting border flanges 81. It will be apparent that these hinge members may be replaced with a single hinge running substantial the length of border flange 81 and together referred to as a hinge member. Sections 20 and border flange sides are covered with cushion pads 25. At the outer end of each section 20 a pair of support legs 30 is attached at the top of the support legs 31 by first pivot means 35. Preferably the support legs 30 are adjustable for height. Each pair of support legs 30 are rigidly connected together by first cross brace 40 or the like. Each section 20 has a pair of support arms or struts 42, each arm comprising a first length or section 50 and a second length or section 60. At the end of the first section 51 the diameter is either smaller or larger in diameter than the top of the second section 61. The section with the larger diameter end or top is sufficiently hallow at the end or top so as to be able to receive the smaller diameter section. This allows the smaller section end or top to be able to be inserted inside of the section with the larger diameter end or top. The difference in circumferences should be such so that the two sections 50 and 60 are capable of overlapping for about 5 inches. This allows the two section 50 and 60 to be joined together or interconnected. When the two sections 50 and 60 are fully engaged it is preferred that there be a uniform diameter along the length if the support arm. It is preferred that first section 50 is made of wood and second section 60 is made of aluminum. Also in the preferred embodiment, end 51 is a male member capable of being received by top 61 a female member. In the preferred embodiment, there is provided a joint means 65 that holds end 51 and top 61 together when the table is folded. It is preferred that the joint means be a cord preferably stretchable or elastic cord sometimes referred to as a "bungy cord". This cord or joint member 65 is secured to the third pivot means 37 at one end 38, runs inside of second section 60 and the other end 39 is secured to the outside of male end 51.

The free end or top of each first length 50 is connected to abutting border flange 81 by second pivot means 36, preferably a plastic ball joint, while the free end or bottom of each second length 60 is connected to support leg 30 by third pivot means 37, preferably a plastic hinge. A pair of flexible, non-stretchable cables 130, are secured between each opposing legs of each leg pair set 30, the cable being of such length to be in tension when said table top sections are coplanar and when said legs are fully unfolded as shown in FIG. 1. The cables 130 are preferably secured to the lower portion of the legs 30. More preferably the cables 130 are secured to the third pivot means 37.

Figure 4:
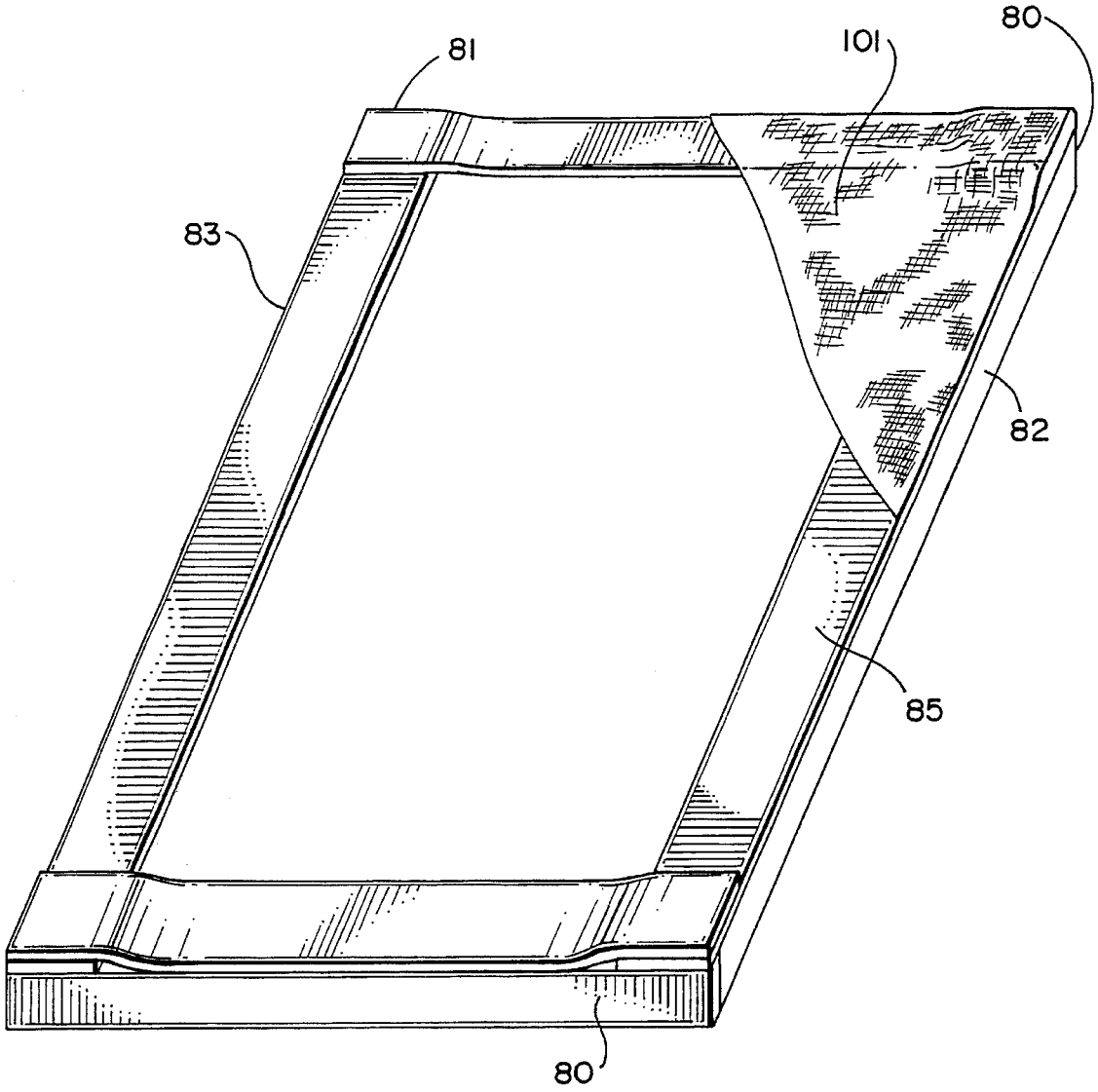
FIG. 4 is a perspective view of a preferred table top section before the cushion pad is applied.

In another preferred embodiment, see FIG. 4, the two top Sections 20 comprise a flexible, stretchable fabric preferably a nylon fabric most preferably 500 Deniur® purchased from Gladwyn. By using a fabric in place of the normal metal or plywood the table becomes lighter and more comfortable to use while retaining the strength and durability required for these types of tables.

The top sections shown in FIG. 4 are preferably manufactured in the following manner: The border flanges 80, which are preferably hardwood, are secured together. Preferably, a ⅛ inch bow is placed in middle border flanges 82 and 83. This is preferably done by placing a spreader or the like between border flanges 82 and 83. While the spreader is still in place plywood strips 85 are affixed or glued to the upper surface of border flanges 80. The fabric 101 is stretched across the top of the strips 85 and secured in place by stables,glue or the like. The ⅛ bow that was applied to the border flanges 80 is compressed by the tension of the stretched fabric. Cushion pad 25 is then applied to the upper surface of the fabric 101. This novel surface is envisioned to work best when used with the above described struts or support arms but can be of great value when used in other tables requiring lightweight and strength.

The above described table can be easily assembled. While on its side, open the table top sections 20 to approximately 150 degrees. Fold out the legs 30 to about 90 degrees of the peripheral border flange 80. Insert the first section end 51 into or over top of second section 61 for all four legs. Open top sections 20 fully and lift into horizontal position. To fold up just reverse the procedure.

All references disclosed are hereby incorporated by reference as if written herein.

From the foregoing description, one skilled in the art can easily ascertain the essential characteristics of this invention, and without departing from the spirit and scope thereof, can make various changes and modifications of the invention to adapt it to various usages and conditions. Accordingly the scope of the invention is not to be considered limited to the particular embodiments shown or suggested, but is rather to be determined by reference to the appended claims.

What is claimed:

1. A portable, folding treatment table comprising:

a pair of rectangular table sections with sides, a top and bottom;

a peripheral border flange depending from said bottom of each of said table sections;

hinge member interconnecting said flange bottom edges of adjacent sides of said table sections to enable folding of said table top sections from a working configuration, wherein said table top sections are coplanar, to a portable configuration, wherein the bottom edges of said flanges are juxtaposed;

two pairs of support legs each leg having a top and bottom;

a first pivot means hingably securing said top of each leg of each said pair of legs to said bottom of each said table sections;

a rigid cross brace secured between said support legs of each pair of legs;

a pair of flexible, non-stretchable cables, connecting one of said pair of support legs to the other of said pair of support legs said cable being of such length so as to be in tension when said table sections are coplanar and when said legs are fully unfolded;

two pairs of support arms, each said support arm comprises a first and a second section each section having a top and bottom;

said bottom of each said first section being of a smaller or larger diameter than said top of said second section and said section with the larger diameter top or bottom has a tubular portion with an internal diameter capable of receiving said smaller top or bottom section thereby allowing said second section to be interconnected to said first section;

a second pivot means hingably securing said tops of each said pair of first sections of arms to said bottom of each said table section; and a third pivot means securing the bottoms of each pair of second sections of arms to said pair of legs.

2. The table as recited in claim 1 further comprising a joint means to secure said bottom of said first section of said support arms to said top of said second section of said support arms when said table is folded.

3. The table as recited in claim 2 wherein said joint means is a stretchable cord.

4. The table as recited in claim 1 wherein said first section of said support arms is made of wood.

5. The table as recited in claim 1 wherein said rectangular table sections are a flexible, stretchable fabric.

6. A portable, folding treatment table comprising:

a pair of peripheral border flanges having sides, a top and bottom;

a fabric stretched over said top of each of said peripheral border flanges and attached thereto;

said peripheral border flanges having a bow that is compressed by said fabric;

hinge member connecting adjacent sides of said peripheral border flanges to enable folding of said peripheral border flanges from a working configuration, wherein said peripheral border flanges are coplanar, to a portable configuration, wherein said bottom of said peripheral border flanges are juxtaposed;

two pairs of support legs each leg having a top and bottom;

a first pivot means hingably securing said top of each leg of each said pair of legs to said peripheral border flanges;

a rigid cross brace secured between said support legs of each pair of legs;

a pair of flexible, non-stretchable cables, connecting one of said pair of support legs to the other of said pair of support legs said cable being of such length to be in tension when said peripheral border flanges are coplanar and when said legs are fully unfolded;

two pairs of support arms with a joint means in the middle of each support arm to allow said support arm to fold each support arm having a top and bottom;

a second pivot means hingably securing said tops of each said pair of support arms to said peripheral border flanges; and a third pivot means securing the bottoms of each pair of second sections of arms to said pair of legs.

7. The table as recited in claim 6 wherein said support arms further comprise a first and second section with a top and bottom said bottom of said first section being of a smaller or larger diameter than said top of said second section and said section with the larger diameter top or bottom has a tubular portion with an internal diameter capable of receiving said smaller top or bottom thereby allowing said second section to be interconnected to said first section.

8. The table as recited in claim 7 wherein said joint means is a stretchable cord.

9. The table as recited in claim 6 further having a cushion pad attached on top of said fabric.

10. A portable, folding treatment table comprising:

a pair of peripheral border flanges having sides, a top and bottom; a fabric stretched over said top of each of said peripheral border flanges and attached thereto;

hinge member connecting adjacent sides of said peripheral border flanges to enable folding of said peripheral border flanges from a working configuration, wherein said peripheral border flanges are coplanar, to a portable configuration, wherein said bottom of said peripheral border flanges are juxtaposed;

two pairs of support legs each leg having a top and bottom;

a first pivot means hingably securing said top of each leg of each said pair of legs to said peripheral border flanges;

a rigid cross brace secured between said support legs of each pair of legs;

a pair of flexible, non-stretchable cables, connecting one of said pair of support legs to the other of said pair of support legs said cable being of such length so as to be in tension when said peripheral border flanges are coplanar and when said legs are fully unfolded;

two pairs of support arms, each said support arm comprises a first and a second section each section having a top and bottom;

said bottom of each said first section being of a smaller or larger diameter than said top of said second section and which ever said section has the larger diameter has a tubular portion with an internal diameter capable of receiving said section with said smaller diameter bottom thereby allowing said second section to be interconnected to said first section;

a second pivot means hingably securing said tops of each said pair of first sections of arms to said bottom of each said peripheral border flanges; and a third pivot means securing the bottoms of each pair of second sections of arms to said pair of legs.

11. The table as recited to claim 10 wherein said peripheral border flanges each have a support strips along the periphery of said top of said peripheral border flanges.

12. The table as recited in claim 11 wherein said support strips are over lapping.

* * * * *